US005178245A

United States Patent [19]

Cox

[11] Patent Number: 5,178,245

[45] Date of Patent: Jan. 12, 1993

[54] SUITCASE CONSTRUCTION INCLUDING REMOVABLE LOOP FRAMES

[75] Inventor: Adrian N. Cox, Kirribilli, Australia

[73] Assignee: Paklite Pty, Ltd., New South Wales, Australia

[21] Appl. No.: 642,868

[22] Filed: Jan. 18, 1991

[30] Foreign Application Priority Data

Oct. 5, 1990 [AU] Australia ..... 63847/90

[51] Int. Cl.[5] ..... A45C 5/14; A45C 7/00; A45C 13/04; A45C 13/36

[52] U.S. Cl. ..... 190/107; 190/18 A; 190/123; 190/127

[58] Field of Search ..... 190/107, 116, 119, 120–125

[56] References Cited

U.S. PATENT DOCUMENTS

| | | | |
|---|---|---|---|
| 1,028,168 | 6/1912 | Williams | 190/127 |
| 1,701,954 | 2/1929 | Lowe | 190/116 X |
| 2,016,520 | 10/1935 | Short | 190/122 X |
| 2,710,084 | 6/1955 | Braverman | 190/127 X |
| 2,718,943 | 9/1955 | Braverman | 190/107 |
| 2,755,896 | 7/1956 | Breglia | 190/127 X |
| 2,806,563 | 9/1957 | Einhorn | 190/107 |
| 3,071,220 | 1/1963 | O'Neil | 190/124 X |
| 4,655,329 | 4/1987 | Kanko | 190/107 |
| 4,813,520 | 3/1989 | Lin | 190/107 |
| 4,895,230 | 1/1990 | King | 190/107 |
| 4,951,818 | 8/1990 | Johnson | 190/107 X |
| 5,031,734 | 7/1991 | King | 190/113 X |
| 5,083,645 | 1/1992 | Lee | 190/113 |

FOREIGN PATENT DOCUMENTS

| | | | |
|---|---|---|---|
| 544391 | 9/1959 | Belgium | 190/113 |
| 0199993 | 11/1986 | European Pat. Off. . | |
| 372074 | 5/1932 | United Kingdom | 190/127 |
| 440288 | 12/1935 | United Kingdom | 190/127 |
| 580515 | 9/1946 | United Kingdom | 190/103 |
| 779784 | 7/1957 | United Kingdom | 190/107 |
| 805342 | 12/1958 | United Kingdom . | |
| 838553 | 6/1960 | United Kingdom . | |
| 1185339 | 3/1970 | United Kingdom | 190/103 |

*Primary Examiner*—Sue A. Weaver
*Attorney, Agent, or Firm*—David P. Gordon

[57] ABSTRACT

A collapsible suitcase consists of a collapsible shell (10) and stiffening frames (23) in the form of resilient loops having a shape corresponding to the lateral cross-sectional shape of the suitcase. The frames may be retained in end compartments (19), or may be located within the central compartment of the case by means of tabs (24) or pockets (25).

11 Claims, 2 Drawing Sheets

SUITCASE CONSTRUCTION INCLUDING REMOVABLE LOOP FRAMES

BACKGROUND OF THE INVENTION

The present invention relates to suitcases, and more particularly to suitcase constructions which allow the suitcase to be collapsed when not in use.

Prior art collapsible suitcases have included cardboard panels at the end walls of the suitcase. These panels are hinged to the suitcase at the bottom, which allows the panels to be folded against the bottom upon collapsing the case. The main disadvantages of this prior art construction are the additional weight and limited support provided by the end panels.

SUMMARY OF THE INVENTION

It is the primary object of the invention to obviate the disadvantages of the prior art, and to provide the consuming public with a choice.

In accord with the object of the invention, a collapsible suitcase is provided which comprises one or more stiffening frames and a collapsible shell having attachment means for the removable attachment of the stiffening frames.

Preferably, the attachment means are adapted to hold the frames inside the shell, preferably adjacent one or more walls of the shell, and more preferably near the ends of the suitcase. The shell may include end compartments adapted to receive the frames to hold the frames against dividing walls separating the end compartments from a central compartment.

The frames may be formed as resilient loops having a shape substantially corresponding to the lateral cross-sectional shape of the inside of the suitcase.

A better understanding of the collapsible suitcase of the present invention, and additional objects and advantages of the invention will become apparent to those skilled in the art upon reference to the detailed description and accompanying drawings.

DETAILED DESCRIPTION OF THE PREFERRED EMBODIMENTS

Figure 1:
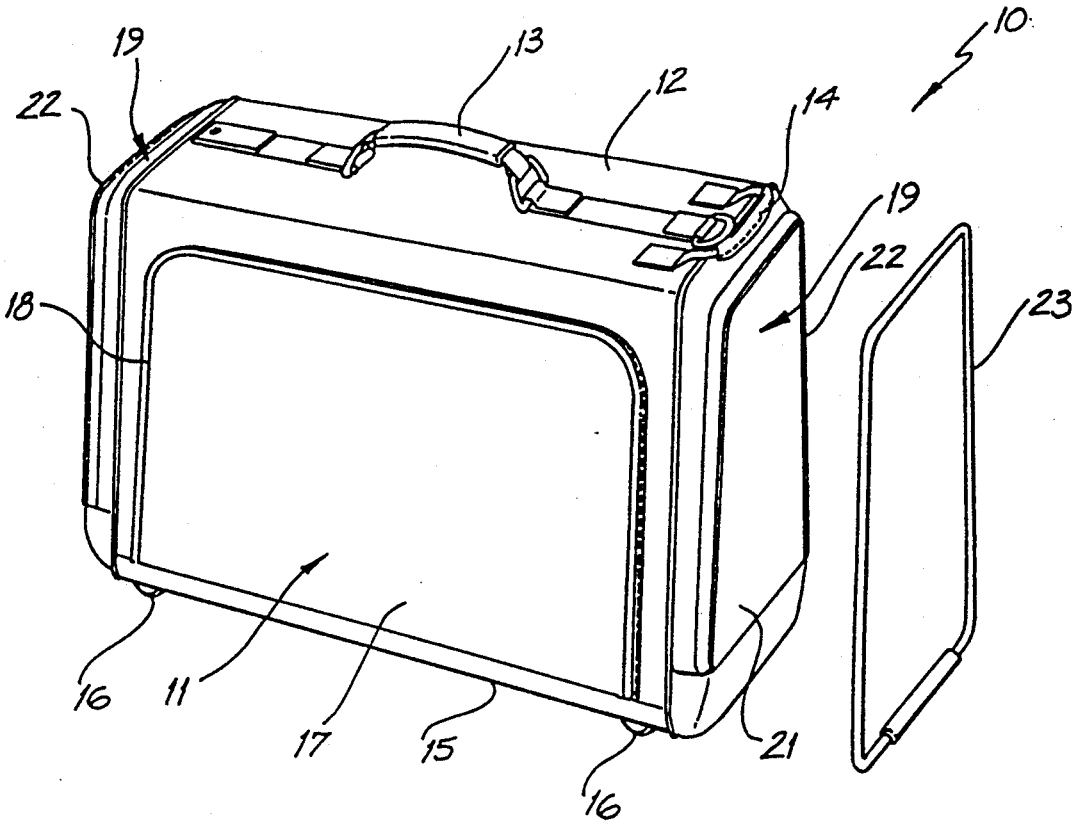
FIG. 1 is an exploded view of the collapsible suitcase of the invention.
Figure 2:
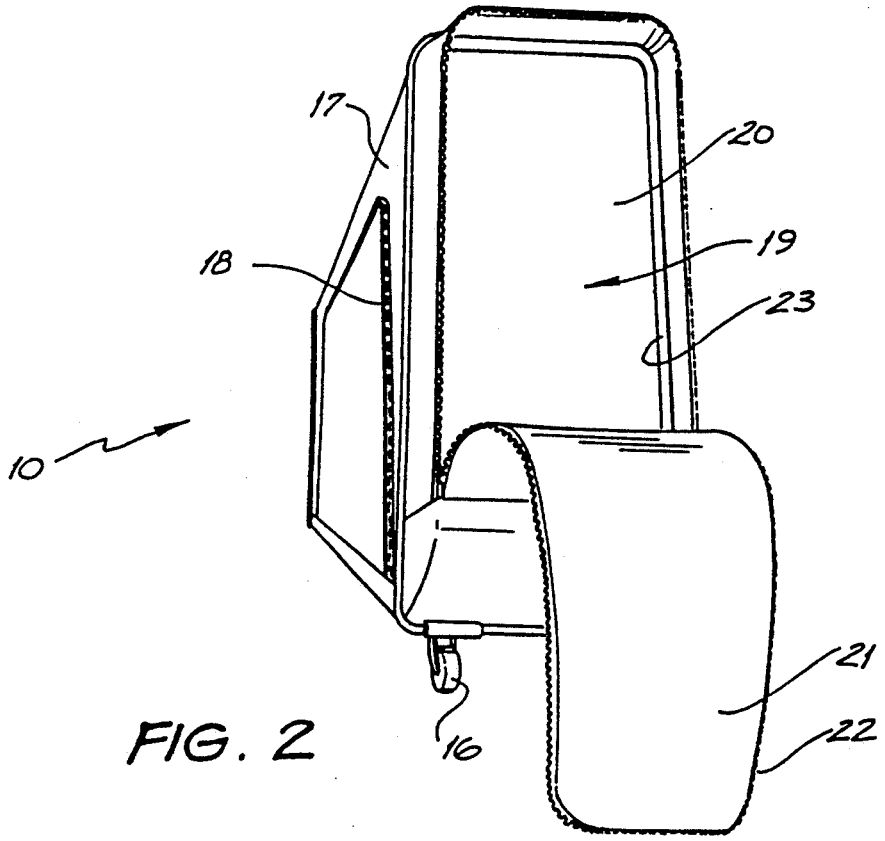
FIG. 2 is a perspective view of the suitcase of FIG. 1 with an end compartment opened to show the stiffening frame in position.

The suitcase 10 of the invention as shown in FIGS. 1 and 2 has a large central compartment 11 of a generally rectangular shape. The top wall 12 of the suitcase is provided with a handle 13 and a corner strap 14 for transport of the suitcase 10. The bottom wall 15 has casters 16. One of the side walls 17 has a sliding clasp fastener (zipper) 18 therein to allow access to the central compartment The suitcase 10 also has end compartments 19 separated from the central compartment 11 by dividing walls 20. The end compartments are tapered as shown, with end walls 21 having sliding clasp fasteners (zippers) 22 to allow access.

The shell of the suitcase 10 may be formed of flexible nylon material or other flexible material known for the manufacture of luggage The top 12 and bottom 15 walls should be reinforced and stiffened to take the weight of clothing or other articles placed in the suitcase.

The suitcase 10 is provided with a pair of removable frames 23 each formed as a resilient loop. The frame may be formed from plastic tubing or the like and is similar in shape to the lateral cross-section of the suitcase. In the case of the illustrated suitcase, the frame is generally rectangular.

To assemble the suitcase, one opens end compartment fasteners (zippers) 22 and inserts a frame in each end compartment 19. As shown best in FIG. 2, the taper of the end compartments holds frames 23 in place against the dividing walls 20. By forming the frames as resilient loops, the frames 23 can be slipped past the opening of the tapered end compartments, and when in place, give a significant degree of lateral stiffness to the suitcase 10 while adding very little weight The stiffened top and bottom walls 12 and 15 provide the end-to-end compression strength. Furthermore, the looped frames 23 take up only a small volume in the end compartments 19, leaving the remainder of the compartments free for use.

To collapse the suitcase 10, one simply removes the frames 23 from the end compartments 19. The frames may be stored in the central compartment 11. Then, the stiffened top and bottom walls 12 and 15 of the suitcase are folded in over one of the side walls 17 to flatten the suitcase 10 for storage.

Figure 3:
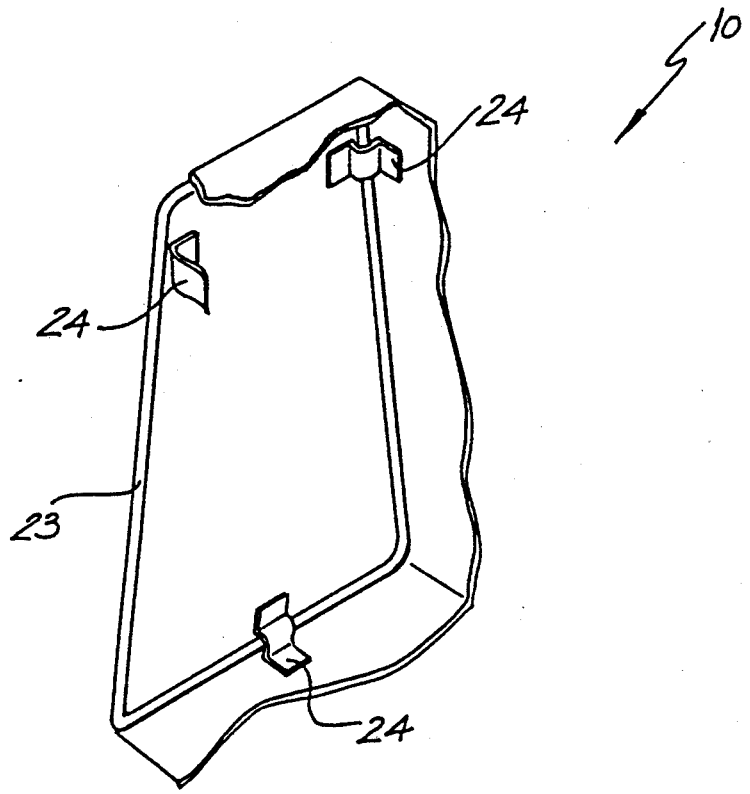
FIGS. 3 and 4 show alternative embodiments of the invention.
Figure 4:
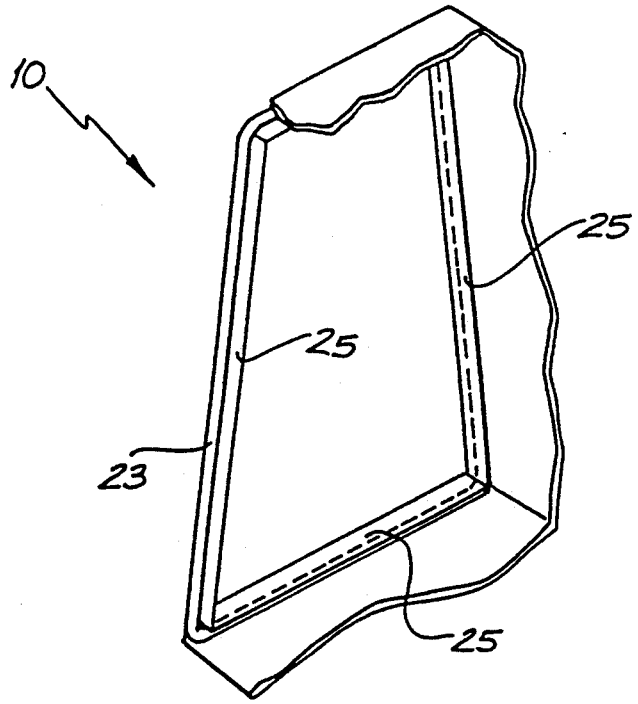

Turning to FIGS. 3 and 4, fragmentary views of the inside of one end of different embodiments of the suitcase invention are seen. In both FIGS. 3 and 4, the frame 23 is removably attached to the inside of the end wall In FIG. 3, the frame is removably attached by means such as tabs 24, with one end of the tabs being detachably secured by a gripping surface material such as that sold under the trademark Velcro. In FIG. 4, the frame is removably attached or held by pockets 25. The embodiments of both FIGS. 3 and 4 allows the present invention to be used in suitcase having a single compartment; i.e. no end compartments.

There have been described and illustrated herein collapsible suitcases. While particular embodiments of the invention have been described, it is not intended that the invention be limited thereby, as it is intended that the invention be as broad in scope as the art will allow. Thus, while one suitcase of the invention has been described as having two end compartments, and other suitcases have been described as having no end compartments, it will be appreciated that a suitcase with one end compartment could be provided, and removable frames using different attachment mechanisms could be utilized. Therefore, it will be apparent to those skilled in the art that yet other changes and modifications may be made to the invention as described without departing from the scope of the invention as so claimed.

I claim:

1. A collapsible suitcase, comprising:

a) two stiffening frames each formed as a resilient loop; and b) a collapsible shell having at least two opposed walls and comprised of end compartments and at least one central compartment, said end compartments being separated from said central compartment by said opposed walls, and said end compartments being adapted to receive said stiffening frames, said collapsible shell further having means for receiving and holding said stiffening frames substantially adjacent respective of said two opposed walls, said stiffening frames being removable from said means for receiving and holding.

2. A suitcase according to claim 1, wherein:

said end compartments are adapted to hold said stiffening frames against said opposed walls.

3. A suitcase according to claim 2, wherein:

said end compartments are tapered to hold said stiffening frames against said opposed walls.

4. A suitcase according to claim 3, wherein:

said end compartments are zippered.

5. A suitcase according to claim 1, wherein:

said central compartment is a main compartment larger in said than said end compartments and having said two opposed walls as end walls thereof, and said means for receiving and holding are disposed within said main compartment and adjacent said end walls.

6. A suitcase according to claim 5, wherein:

said means for receiving and holding comprise tabs attached to said collapsible shell.

7. A suitcase according to claim 5, wherein:

the shape of said resilient loops substantially corresponds to the shape of said opposed walls.

8. A suitcase according to claim 1, wherein:

the shape of said resilient loops substantially corresponds to the shape of said opposed walls.

9. A collapsible suitcase, comprising:

a) at least two stiffening frames; and b) a collapsible shell having a reinforced stiffened top wall, a bottom wall, a side wall having a zippered opening, opposed end walls, and means for receiving and holding said stiffening frames inside said collapsible shell and substantially adjacent said opposed end walls, said stiffening frames being removable from said collapsible shell, wherein said at least two stiffening frames are formed as resilient loops, the shape of said resilient loops substantially corresponding to the shape of said opposed end walls and the width of said bottom and top walls.

10. A collapsible suitcase comprising:

a) at least two stiffening frames; and b) a collapsible shell comprising 1) a central compartment having a reinforced stiffening top wall, a bottom wall, a side wall having a zippered opening, and opposed walls forming end walls of said central compartment, 2) end compartments with zippered openings being separated from said central compartment by said opposed walls, and 3) means for receiving and holding said stiffening frames inside said collapsible shell and substantially adjacent said opposed walls, said at least two stiffening frames being removable from said collapsible shell, wherein said at least two stiffening frames are formed as resilient loops, the shape of said resilient loops substantially corresponding to the shape of said opposed walls and the width of said bottom and top walls.

11. A suitcase according to claim 10, wherein:

said end compartments are adapted to receive through said zippered openings said stiffening frames.

* * * * *